US009615606B2

(12) United States Patent
Liu

(10) Patent No.: US 9,615,606 B2
(45) Date of Patent: Apr. 11, 2017

(54) ELECTRONIC CIGARETTE CHARGING DEVICE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 770 days.

(21) Appl. No.: 14/062,589

(22) Filed: Oct. 24, 2013

(65) Prior Publication Data

US 2015/0059785 A1 Mar. 5, 2015

(30) Foreign Application Priority Data

Sep. 3, 2013 (CN) ..... 2013 2 0544607

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

2012/0227753 A1* 9/2012 Newton ..... A24F 47/008 131/347
2015/0020831 A1* 1/2015 Weigensberg ..... A24F 47/008 131/329

* cited by examiner

*Primary Examiner* — Vuthe Siek
(74) *Attorney, Agent, or Firm* — Tim Tingkang Xia, Esq.; Locke Lord LLP

(57) ABSTRACT

An electronic cigarette charging device configured for charging a battery pole of an electronic cigarette is provided; an external electrode and an internal electrode configured for electrically connecting with the electronic cigarette charging device are mounted on an end of the battery pole; the electronic cigarette charging device includes a pillared first charging electrode corresponding to the internal electrode, and the first charging electrode abuts against the internal electrode when the electronic cigarette is charged using the electronic cigarette charging device. When implementing the electronic cigarette charging device of the present application, the following advantageous effects can be achieved: the electronic cigarette charging device adopts a pillared charging electrode to charge the electronic cigarette, so that a contacting area between the charging electrode and the electronic cigarette is increased, and the stability of the charging process of the electronic cigarette charging device is improved.

16 Claims, 4 Drawing Sheets

ELECTRONIC CIGARETTE CHARGING DEVICE

CROSS-REFERENCE TO RELATED APPLICATIONS

This non-provisional application claims priorities under 35 U.S.C. §119(a) on Patent Application No. 201320544607.7 filed in P.R. China on Sep. 3, 2013, the entire contents of which are hereby incorporated by reference.

FIELD OF THE INVENTION

The present application relates to the field of electrical products, and more particularly relates to an electronic cigarette charging device.

BACKGROUND OF THE INVENTION

Electronic cigarettes are mainly used for quitting smoking and substituting tobacco. At present, an electronic cigarette on the market generally includes a battery pole and an atomizer. When the electronic cigarette is smoked, a battery in the battery pole supplies electric power to the atomizer, and a heating filament of the atomizer is driven to heat tobacco juice to generate smoke. The electronic cigarette is an electrical product that may consume much electrical energy in a short time. Because a battery capacity of the electronic cigarette is limited, a user needs to charge the electronic cigarette when the electronic cigarette is repeatedly used. However, most existing charging devices are inconvenient to carry (not portable) and are only capable of charging electronic cigarettes in places with usable external power source systems, which severely limits portability and use convenience of the electronic cigarettes. Furthermore, most existing charging devices charge electronic cigarettes via conductive wires, which may cause instability of the charging processes.

SUMMARY OF THE INVENTION

The objective of the present application is to provide a electronic cigarette charging device that is portable and can charge an electronic cigarette stably, aiming at the defects in the prior art that electronic cigarette charging devices are not portable and the charge processes of the electronic cigarette charging devices are not stable.

The technical solutions of the present application for solving the technical problems are as follows:

in one aspect, an electronic cigarette charging device configured for charging a battery pole of an electronic cigarette is provided; an external electrode and an internal electrode configured for electrically connecting with the electronic cigarette charging device are mounted on an end of the battery pole; the electronic cigarette charging device includes a pillared first charging electrode corresponding to the internal electrode, and the first charging electrode abuts against the internal electrode when the electronic cigarette is charged using the electronic cigarette charging device.

In one embodiment, the electronic cigarette charging device comprises a mounting seat, a first elastic plate fixed on the mounting seat, and a second elastic plate fixed on the mounting seat; the first elastic plate and the second elastic plate cooperatively form an elastic plate switch configured for triggering charging processes of the electronic cigarette charging device; and when the electronic cigarette is charged using the electronic cigarette charging device, the elastic plate switch is turned on, the first charging electrode is electrically connected to the internal electrode, and the first elastic plate is electrically connected to the external electrode.

In another embodiment, the first charging electrode is elastically and telescopically mounted on an end surface of the mounting seat facing the electronic cigarette; when the electronic cigarette is charged using the electronic cigarette charging device, the first elastic plate is pressed by the gravity of the electronic cigarette, and the first elastic plate is elastically deformed and abuts against the second elastic plate to turn the elastic plate switch on.

In another embodiment, the mounting seat includes a seat body; the seat body defines an accommodating cavity configured for accommodating the first charging electrode; the end surface of the mounting seat facing the electronic cigarette is defined as a first end surface; the first end surface is located on the seat body, and a first through-hole communicating with the accommodating cavity is defined in the first end surface; and the first charging electrode is inserted in the first through-hole.

In another embodiment, the first charging electrode includes an electrode pillar and an elastic member; the elastic member includes a connecting portion and an abutting portion;

the connecting portion is connected to the electrode pillar; the abutting portion abuts against an inner side surface of the seat body facing the first end surface; and the electrode pillar partially extends out of the seat body when the elastic plate switch is turned off; and the electrode pillar is pressed to abut against the internal electrode when the elastic plate switch is on.

In another embodiment, the elastic member is an elastic plate or a spring.

In another embodiment, the electronic cigarette charging device further comprises a PCB having a charging circuit; the seat body includes a second end surface; the PCB longitudinally running through the accommodating cavity is fixed on the second end surface; and the PCB is electrically connected to the first elastic plate, the second elastic plate and the first charging electrode respectively.

In another embodiment, the first elastic plate includes a second charging electrode configured for elastically abutting against the second elastic plate, and an end of the second charging electrode bends to form a first connecting section; the second charging electrode defines a second through-hole configured for enabling the first charging electrode to pass through; the first connecting section is fixed on a first side surface of the seat body that is adjacent to the first end surface;

an end of the second charging electrode connected to the first connecting section is a fixed end; and an end of the second charging electrode that is opposite to the fixed end is a free end.

In another embodiment, the second through-hole is spaced with the peripheral surface of the first charging electrode, so that the first charging electrode is electrically isolated with the second charging electrode.

In another embodiment, the second elastic plate includes a contact electrode configured for elastically abutting against the first elastic plate; an end of the contact electrode bends to form a second connecting section; and the second connecting section is fixed on a second side surface of the seat body facing the first side surface.

In another embodiment, when the second charging electrode and the first connecting section form an angle that is more than 90 degrees, with the fixed end serving as a vertex of the angle, the elastic plate switch is turned off; and when the second charging electrode is pressed, the free end moves in an arc towards the first end surface, with the fixed end serving as a pivot point of the arc-shaped movement, so that the second charging electrode contacts the contact electrode to turn the elastic plate switch on.

In another embodiment, the seat body defines a first elastic plate mounting recess fitting for the first elastic plate and a second elastic plate mounting recess fitting for the second elastic plate.

In another embodiment, the first elastic plate mounting recess is defined in the first side surface, and at least one first buckle is formed in the first elastic plate mounting recess; and at least one first buckling recess fitting for the first buckle is defined in the first connecting section, and the first elastic plate is buckled with the first elastic plate mounting recess via the first buckling recess.

In another embodiment, the first elastic plate further includes a first abutting section extending from the first connecting section to a side of the PCB; and the first abutting section elastically abuts against the PCB and electrically connects with the PCB.

In another embodiment, the second elastic plate mounting recess is defined in the second side surface, and at least one second buckle is formed in the second elastic plate mounting recess; and at least one second buckling recess fitting for the second buckle is defined in the second connecting section, and the second elastic plate is buckled with the second elastic plate mounting recess via the second buckling recess.

In another embodiment, the second elastic plate further includes a second abutting section extending from the second connecting section to a side of the PCB; and the second abutting section elastically abuts against the PCB and electrically connects with the PCB.

In another embodiment, the electronic cigarette charging device is an electronic cigarette case.

When implementing the electronic cigarette charging device of the present application, the following advantageous effects can be achieved: the electronic cigarette charging device can be designed to be an electronic cigarette case that can accommodate an electronic cigarette and have a charging function, so that the electronic cigarette can be charged when the electronic cigarette is placed in the electronic cigarette case, and thus the electronic cigarette is easy to carry. The electronic cigarette charging device adopts a pillared charging electrode to charge the electronic cigarette, so that a contacting area between the charging electrode and the electronic cigarette is increased, and the stability of the charging process of the electronic cigarette charging device is improved.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENT

Figure 1:
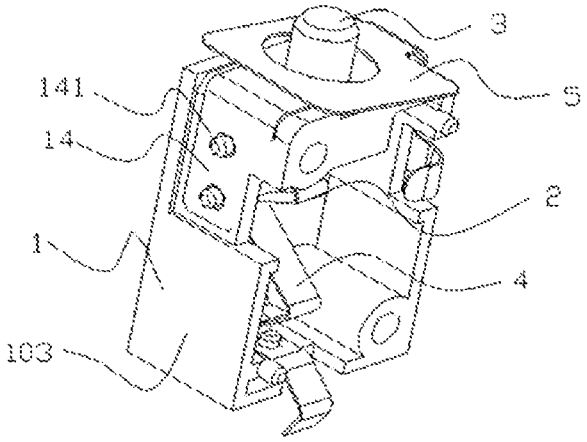
FIG. 1 is a structural schematic view of a charging assembly of an electronic cigarette charging device of a first preferred embodiment of the present application.

To make the technical feature, objective and effect of the present application be understood more clearly, now the specific implementation of the present application is described in detail with reference to the accompanying drawings and embodiments.

As shown in FIGS. 1 to 7, in an electronic cigarette charging device of a first preferred embodiment of the present application, the electronic cigarette charging device is an electronic cigarette case that can accommodate at least one electronic cigarette and has a charging function, and is configured for charging a battery pole A of the electronic cigarette. An external electrode (not labeled) and an internal electrode (not labeled) configured to electrically connect with the electronic cigarette charging device are mounted on an end of the battery pole A. Specifically, the battery pole A of this embodiment is detachably connected to an atomizer, and the external electrode and the internal electrode are disposed on an end of the battery pole A connected to the atomizer. The electronic cigarette is in the prior art, and is not described here. It is understood that the electronic cigarette charging device of the present application can also charge an electronic cigarette comprising the battery pole A integrated with the atomizer. In this situation, the external electrode and the internal electrode are mounted on an end of the battery pole A that is away from the atomizer.

The electronic cigarette charging device comprises a charging assembly B, and the charging assembly B includes a mounting seat 1, a first charging electrode 2, a first elastic plate 5, and a second elastic plate 6. The first charging electrode 2 is a pillar, and includes an electrode pillar 3 and an elastic member 4. When the electronic cigarette is charged using the electronic cigarette charging device, the first charging electrode 2 abuts against the internal electrode of the battery pole A. The first elastic plate 5 and the second elastic plate 6 cooperatively form an elastic plate switch configured for triggering charging processes of the electronic cigarette charging device. The elastic plate switch has a turned-on status and a turned-off status. When the elastic plate switch is turned on, the first charging electrode 2 is electrically connected to the internal electrode, and the first elastic plate 5 is electrically connected to the external electrode. In this embodiment, the elastic member 4 is also an elastic plate.

Figure 2:
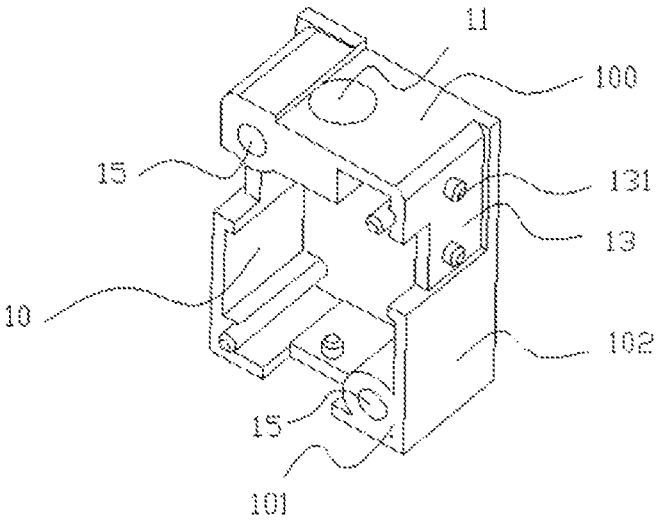
FIG. 2 is a structural schematic view of a mounting seat of the charging assembly shown in FIG. 1.

As shown in FIGS. 1 and 2, the mounting seat 1 includes a seat body 10, a first through-hole 11, a first elastic plate mounting recess 13, a second elastic plate mounting recess 14, and a connecting hole 15. The seat body 10 is approximately a hollow cuboid. An accommodating cavity configured for accommodating the first charging electrode 2 is defined in the seat body 10. An outer surface of the seat body 10 includes a first end surface 100 abutting the electronic cigarette, a first side surface 102 adjacently connected to the first end surface 100, and a second side surface 103 that is opposite to the first side surface 102. The outer surface of the seat body 10 further includes a second end surface 101, and the connecting hole 15 is defined in the second end surface 101 and is configured for connecting with a PCB (Printed Circuit Board, not shown).

The first through-hole 11 is defined in the first end surface 100 of the seat body 10 and communicates with the accommodating cavity. The first through-hole 11 is a pillar-shaped hole fitting for the first charging electrode 2, and the first charging electrode 2 runs through the seat body 10 and is elastically and telescopically inserted in the first through-hole 11.

The first elastic plate mounting recess 13 is defined in the first side surface 102 of the seat body 10. At least one first buckle 131 is formed in the first elastic plate mounting recess 13. A section of the first buckle 131 can be circular or polygonal, etc. When the number of the first buckles 131 is more than one, the first buckles 131 are formed in the first elastic plate mounting recess 13, and spaced with each other. The first elastic plate 5 is buckled with the first buckle(s) 131 to connect with the seat body 10.

The second elastic plate mounting recess 14 is defined in the second side surface 103 of the seat body 10. At least one second buckle 141 is formed in the second elastic plate mounting recess 14. A section of the second buckle 141 can be circular or polygonal, etc. When the number of the second buckles 141 is more than one, the second buckles 141 are formed in the second elastic plate mounting recess 14 and spaced with each other. The second elastic plate 6 is buckled with the second buckle(s) 141 to connect with the seat body 10.

Besides, the electronic cigarette charging device further includes a PCB (not shown). The PCB includes a charging circuit, and is fixed on the mounting seat 1 by at least one fastener. The connecting hole 15 of the mounting seat 1 and the fastener cooperatively make the PCB longitudinally run through the accommodating cavity and be fixed on the second end surface 101. The PCB is electrically connected to the first elastic plate 5, the second elastic plate 6, and an end of the first charging electrode 2 respectively.

Figure 3:
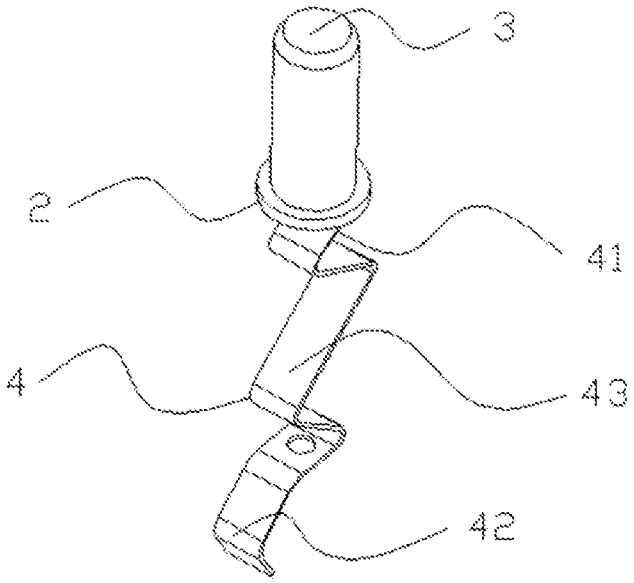
FIG. 3 is a structural schematic view of a first charging electrode of the charging assembly shown in FIG. 1.

As shown in FIG. 3, the first charging electrode 2 includes the electrode pillar 3 and the elastic member 4. One end of the electrode pillar 3 abuts against the internal electrode of the battery pole A, and the other end of the electrode pillar 3 is connected to the elastic member 4 by riveting or other conventional ways. The electrode pillar 3 is pillar-shaped, and contacts the internal electrode by means of surface contact, so that the contacting area between the electrode pillar 3 and the internal electrode of the electronic cigarette is increased, and the stability of charging processes of the electronic cigarette charging device is effectively improved. It can be understood that, in other embodiments, the electrode pillar 3 can also be a T-shaped or L-shaped elastic plate, and the internal electrode contacts the T-shaped or L-shaped elastic plate by means of surface contact too.

The elastic member 4 includes a connecting portion 41, an abutting portion 42 and a compressed portion 43 disposed between the connecting portion 41 and the abutting portion 42. The connecting portion 41 is connected to the electrode pillar 3. The abutting portion 42 abuts against an inner side surface of the seat body 10 facing the first end surface 100. The electrode pillar 3 partially extends out of the seat body 10 when the elastic plate switch is turned off, and the electrode pillar 3 is pressed to abut against the internal electrode when the elastic plate switch is turned on.

Figure 4:
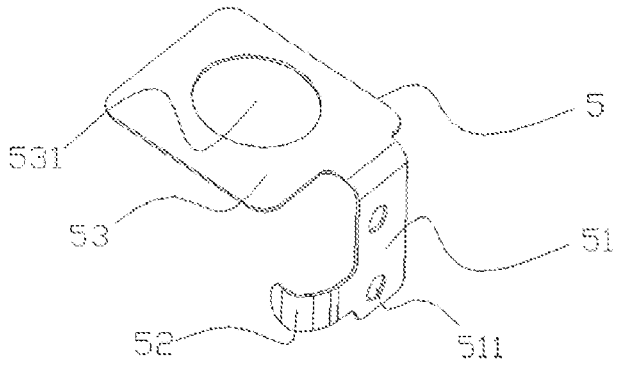
FIG. 4 is a structural schematic view of a first elastic plate of the charging assembly shown in FIG. 1.

As shown in FIG. 4, the first elastic plate 5 includes a first connecting section 51, a first abutting section 52 formed by an end of the first connecting section 51 bent towards a side of the PCB, and a second charging electrode 53 formed by another end of the first connecting section 51 bent towards a side of the first end surface 100. The first abutting section 52 elastically abuts against the PCB to electrically connect with the PCB.

At least one first buckling recess 511 is defined in the first connecting section 51. If the number of the first buckling recesses 511 is more than one, the first buckling recesses 511 are spaced with each other. The first buckling recess 511 is fit for the first buckle 131 formed in the first elastic plate mounting recess 13. A cross section of the first buckling recess 511 can be circular or polygonal, etc. The first elastic plate 5 is buckled with the first buckling recess 511 to connect with the first elastic plate mounting recess 13.

The second charging electrode 53 is approximately platy. One end of the second charging electrode 53 connected to the first connecting section 51 is a fixed end, and another end of the second charging electrode 53 that is opposite to the end of the second charging electrode 53 connected to the first connecting section 51 is a free end. In a natural state, the free end turns up, and the second charging electrode 53 and the first connecting section 51 form an angle that is more than 90 degrees, with the fixed end serving as a vertex of the angle.

Besides, a second through-hole 531 configured for enabling the first charging electrode 2 to run through is defined in the second charging electrode 53. The second charging electrode 53 is sheathed on the first charging electrode 2 via the second through-hole 531. The second through-hole 531 is spaced with the peripheral surface of the first charging electrode 2, so that the first charging electrode 2 is electrically isolated from the second charging electrode 53. A cross section of the second through-hole 531 can be circular or polygonal, etc.

Figure 5:
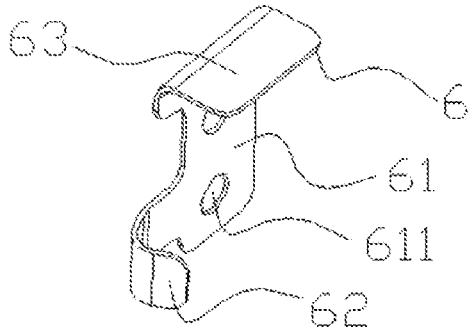
FIG. 5 is a structural schematic view of a second elastic plate of the charging assembly of the first preferred embodiment of the present application.

As shown in FIG. 5, the second elastic plate 6 is approximately platy. The second elastic plate 6 includes a second connecting section 61, a second abutting section 62 formed by an end of the second connecting section 61 bent towards a side of the PCB, and a contact electrode 63 formed by another end of the second connecting section 61 extending towards a side of the first end surface 100. The second abutting section 62 elastically abuts against the PCB to electrically connect with the PCB. The contact electrode 63 is attached on the first end surface 100 of the seat body 10.

At least one second buckling recess 611 is defined in the second connecting section 61. If the number of the second buckling recesses 611 is more than one, the second buckling recesses 611 are spaced with each other. The second buckling recess 611 is fit for the second buckle 141 formed in the second elastic plate mounting recess 14. The second buckling recess 611 can be circular or polygonal, etc. The second elastic plate 6 is buckled with the second buckling recess 611 to connect with the second elastic plate mounting recess 14.

When the battery pole A of the electronic cigarette is connected to the electronic cigarette charging device, under the gravity action of the battery pole A of the electronic cigarette, the free end of the second charging electrode 53 moves in an arc towards the first end surface 100, with the fixed end serving as a pivot point of the arc-shaped movement, and thus the second charging electrode 53 is enabled to contact the contact electrode 63 and electrically connect with the contact electrode 63. In a natural state, the free end of the second charging electrode 53 slightly turns up, and is electrically isolated from the contact electrode 63. Thus, the second charging electrode 53 and the contact electrode 63 cooperatively form the elastic plate switch. When the battery pole A of the electronic cigarette is connected to the electronic cigarette charging device, the second charging electrode 53 contacts the contact electrode 63 to turn the elastic plate switch on, and the battery pole A of the electronic cigarette is charged. When the battery pole A of the electronic cigarette isn't connected to the electronic cigarette charging device, the second charging electrode 53 is electrically isolated from the contact electrode 63 to turn the elastic plate switch off.

Figure 6:
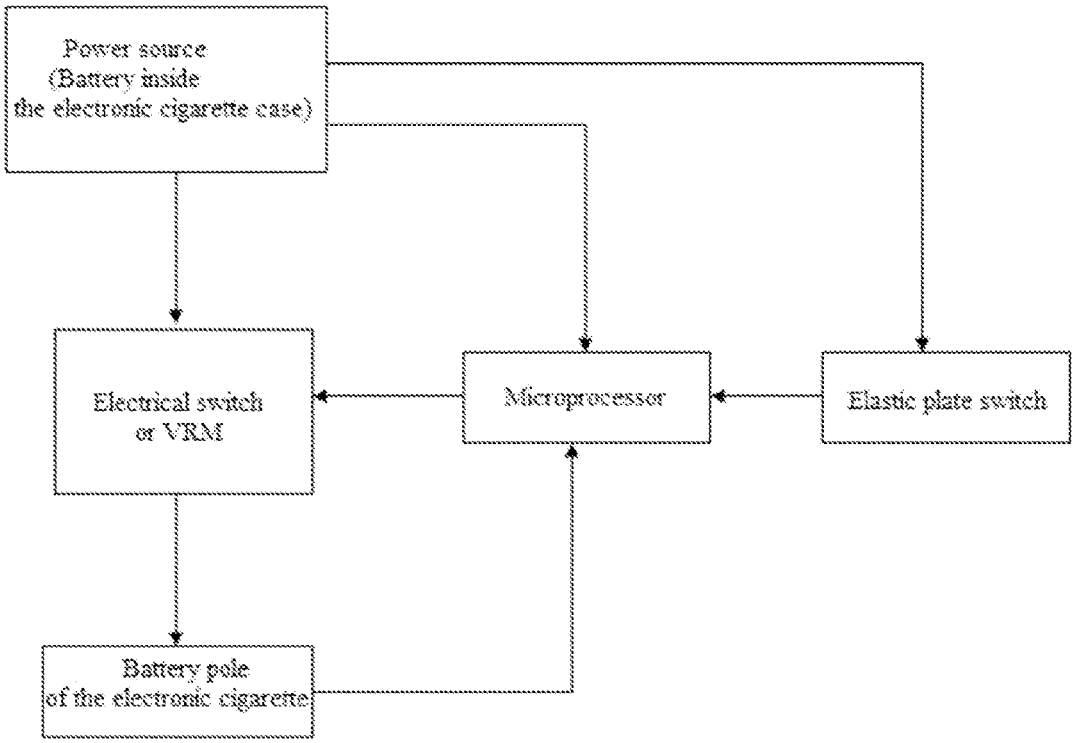
FIG. 6 is a block diagram of a preferred circuit of the present application.
Figure 7:
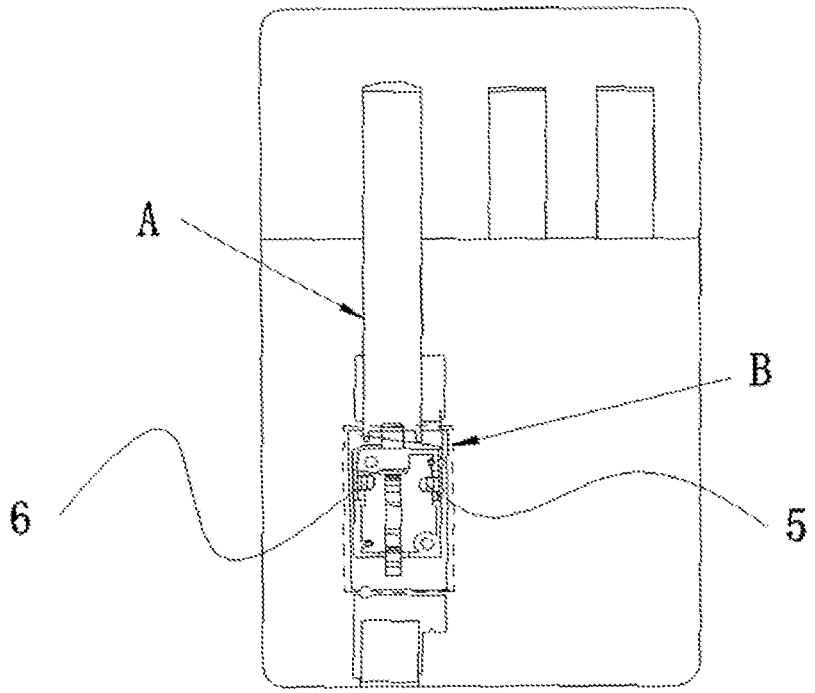
FIG. 7 is another structural schematic view of the electronic cigarette charging device of the first preferred embodiment of the present application.

Besides, the charging assembly further includes a power source, a microprocessor, and an electrical switch (not shown). As shown in FIG. 6, when the elastic plate switch of the electronic cigarette charging device is turned on, the elastic plate switch sends a charging trigger signal to the microprocessor. Upon receiving this charging trigger signal, the microprocessor drives the power source to charge the battery pole A by controlling the electrical switch. Therefore, when the elastic plate switch is turned on, the electronic cigarette charging device charges the battery pole A; and when the elastic plate switch is turned off, the electronic cigarette charging device doesn't charge the battery pole A. When the elastic plate switch is turned on, the first abutting section 52 of the first elastic plate 5 is electrically connected to the PCB, the second charging electrode 53 of the first elastic plate 5 is connected to the contact electrode 63 of the second elastic plate 6, and the second abutting section 62 of the second elastic plate 6 is electrically connected to the PCB, so that a galvanic circle is formed.

Therefore, when the elastic plate switch is turned on, the abutting portion 42 of the elastic member 4 is electrically connected to the PCB, the connecting portion 41 of the elastic member 4 is electrically connected to the electrode pillar 3, and the electrode pillar 3 is further electrically connected to the internal electrode of the battery pole A. Thus, when the electronic cigarette charging device is working, charging current can pass through the elastic member 4 and the electrode pillar 3 in turn and arrive at one end of a rechargeable battery (not shown) in the battery pole A. Furthermore, the first abutting section 52 of the first elastic plate 5 is electrically connected to the PCB, and the second charging electrode 53 of the first elastic plate 5 is further electrically connected to the external electrode of the battery pole A. Thus, when the electronic cigarette charging device is working, the charging current further flows from the other end of the rechargeable battery in the battery pole A to the PCB through the second charging electrode 53, so that a charging circle is formed. In this way, the electronic cigarette charging device charges the electronic cigarette stably. It is understood that the electrical switch can be replaced by a VRM (voltage regulator module) to provide a fit charging power source for the electronic cigarette, so that the battery pole A can be charged quickly.

Figure 8:
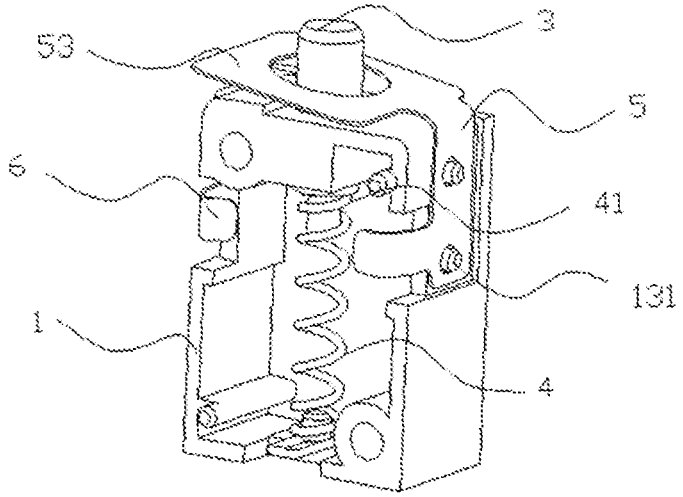
FIG. 8 is structural schematic view of a charging assembly of an electronic cigarette charging device of a second preferred embodiment of the present application.

FIG. 8 shows an electronic cigarette charging device of a second embodiment of the present application. The second embodiment differs from the first embodiment in the structure of the elastic member 4. The elastic member 4 of the second embodiment is a conductive spring.

While the embodiments of the present application are described with reference to the accompanying drawings above, the present application is not limited to the above-mentioned specific implementations. In fact, the above-mentioned specific implementations are intended to be exemplary not to be limiting. In the inspiration of the present application, those ordinary skills in the art can also make many modifications without breaking away from the subject of the present application and the protection scope of the claims. All these modifications belong to the protection of the present application.

What is claimed is:

1. An electronic cigarette charging device configured for charging a battery pole of an electronic cigarette, an external electrode and an internal electrode configured for electrically connecting with the electronic cigarette charging device mounted on an end of the battery pole; wherein, the electronic cigarette charging device includes a pillared first charging electrode corresponding to the internal electrode;

wherein the electronic cigarette charging device comprises a mounting seat, a first elastic plate fixed on the mounting seat, and a second elastic plate fixed on the mounting seat; the first elastic plate and the second elastic plate cooperatively form an elastic plate switch configured for triggering charging processes of the electronic cigarette charging device; and when the electronic cigarette is charged using the electronic cigarette charging device, the elastic plate switch is turned on, the first charging electrode abuts against the internal electrode and is electrically connected to the internal electrode, and the first elastic plate is electrically connected to the external electrode.

2. The electronic cigarette charging device according to claim 1, wherein, the first charging electrode is elastically and telescopically mounted on an end surface of the mounting seat facing the electronic cigarette; when the electronic cigarette is charged using the electronic cigarette charging device, the first elastic plate is pressed by the gravity of the electronic cigarette, and the first elastic plate is elastically deformed and abuts against the second elastic plate to turn the elastic plate switch on.

3. The electronic cigarette charging device according to claim 2, wherein, the mounting seat includes a seat body; the seat body defines an accommodating cavity configured for accommodating the first charging electrode; the end surface of the mounting seat facing the electronic cigarette is defined as a first end surface; the first end surface is located on the seat body, and a first through-hole communicating with the accommodating cavity is defined in the first end surface; and the first charging electrode is inserted in the first through-hole.

4. The electronic cigarette charging device according to claim 3, wherein, the first charging electrode includes an electrode pillar and an elastic member; the elastic member includes a connecting portion and an abutting portion;

the connecting portion is connected to the electrode pillar; the abutting portion abuts against an inner side surface of the seat body facing the first end surface; and the electrode pillar partially extends out of the seat body when the elastic plate switch is turned off; and the electrode pillar is pressed to abut against the internal electrode when the elastic plate switch is on.

5. The electronic cigarette charging device according to claim 4, wherein, the elastic member is an elastic plate or a spring.

6. The electronic cigarette charging device according to claim 5, wherein, the electronic cigarette charging device further comprises a PCB having a charging circuit; the seat body includes a second end surface; the PCB longitudinally running through the accommodating cavity is fixed on the second end surface; and the PCB is electrically connected to the first elastic plate, the second elastic plate and the first charging electrode respectively.

7. The electronic cigarette charging device according to claim 3, wherein, the first elastic plate includes a second charging electrode configured for elastically abutting against the second elastic plate, and an end of the second charging electrode bends to form a first connecting section; the second charging electrode defines a second through-hole configured for enabling the first charging electrode to pass through; the first connecting section is fixed on a first side surface of the seat body that is adjacent to the first end surface;

an end of the second charging electrode connected to the first connecting section is a fixed end; and an end of the second charging electrode that is opposite to the fixed end is a free end.

8. The electronic cigarette charging device according to claim 7, wherein, the second through-hole is spaced with the peripheral surface of the first charging electrode, so that the first charging electrode is electrically isolated with the second charging electrode.

9. The electronic cigarette charging device according to claim 8, wherein, the second elastic plate includes a contact electrode configured for elastically abutting against the first elastic plate; an end of the contact electrode bends to form a second connecting section; and the second connecting section is fixed on a second side surface of the seat body facing the first side surface.

10. The electronic cigarette charging device according to claim 9, wherein, when the second charging electrode and the first connecting section form an angle that is more than 90 degrees, with the fixed end serving as a vertex of the angle, the elastic plate switch is turned off; and when the second charging electrode is pressed, the free end moves in an arc towards the first end surface, with the fixed end serving as a pivot point of the arc-shaped movement, so that the second charging electrode contacts the contact electrode to turn the elastic plate switch on.

11. The electronic cigarette charging device according to claim 3, wherein, the seat body defines a first elastic plate mounting recess fitting for the first elastic plate and a second elastic plate mounting recess fitting for the second elastic plate.

12. The electronic cigarette charging device according to claim 11, wherein, the first elastic plate mounting recess is defined in the first side surface, and at least one first buckle is formed in the first elastic plate mounting recess; and at least one first buckling recess fitting for the first buckle is defined in the first connecting section, and the first elastic plate is buckled with the first elastic plate mounting recess via the first buckling recess.

13. The electronic cigarette charging device according to claim 12, wherein, the first elastic plate further includes a first abutting section extending from the first connecting section to a side of the PCB; and the first abutting section elastically abuts against the PCB and electrically connects with the PCB.

14. The electronic cigarette charging device according to claim 11, wherein, the second elastic plate mounting recess is defined in the second side surface, and at least one second buckle is formed in the second elastic plate mounting recess; and at least one second buckling recess fitting for the second buckle is defined in the second connecting section, and the second elastic plate is buckled with the second elastic plate mounting recess via the second buckling recess.

15. The electronic cigarette charging device according to claim 14, wherein, the second elastic plate further includes a second abutting section extending from the second connecting section to a side of the PCB; and the second abutting section elastically abuts against the PCB and electrically connects with the PCB.

16. The electronic cigarette charging device according to claim 1, wherein, the electronic cigarette charging device is an electronic cigarette case.

* * * * *